US007778570B2

(12) United States Patent
Numagami et al.

(10) Patent No.: US 7,778,570 B2
(45) Date of Patent: Aug. 17, 2010

(54) IMAGE FORMING APPARATUS

(75) Inventors: Atsushi Numagami, Hadano (JP); Masatomo Tsuzuki, Chiba (JP); Masaki Kakitani, Abiko (JP); Akira Yoshimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 188 days.

(21) Appl. No.: 12/183,850

(22) Filed: Jul. 31, 2008

(65) Prior Publication Data

US 2009/0041498 A1 Feb. 12, 2009

(30) Foreign Application Priority Data

Aug. 10, 2007 (JP) ..... 2007-210107
Jun. 10, 2008 (JP) ..... 2008-152101
Jul. 15, 2008 (JP) ..... 2008-183893

(51) Int. Cl.
*G03G 21/16* (2006.01)

(52) U.S. Cl. ..... 399/111; 399/114; 399/120

(58) Field of Classification Search ..... 399/107, 399/111, 114, 119, 120, 252, 258, 262
See application file for complete search history.

(56) References Cited

U.S. PATENT DOCUMENTS 6,426,767 B1 7/2002 Tanimoto et al. ..... 347/115
6,795,660 B2 * 9/2004 Yugeta et al. ..... 399/27
6,978,103 B2 12/2005 Miura et al. ..... 399/116
7,203,446 B2 4/2007 Miura et al. ..... 399/116
7,440,724 B2 * 10/2008 Morita et al. ..... 399/351
7,496,317 B2 * 2/2009 Igarashi et al. ..... 399/124
7,660,549 B2 * 2/2010 Noguchi et al. ..... 399/110
7,684,730 B2 * 3/2010 Furuta et al. ..... 399/121
2002/0085081 A1 7/2002 Tanimoto et al. ..... 347/115
2005/0147432 A1 7/2005 Miura et al. ..... 399/250
2006/0051133 A1 3/2006 Koishi et al. ..... 399/167
2006/0140668 A1 6/2006 Sato et al. ..... 399/110
2006/0210306 A1 9/2006 Okamoto ..... 399/119
2006/0251445 A1 11/2006 Ueno et al. ..... 399/102
2007/0110478 A1 5/2007 Numagami et al. ..... 399/167
2007/0160388 A1 7/2007 Yoshimura et al. ..... 399/111
2008/0159772 A1 7/2008 Koishi et al. ..... 399/90
2008/0159773 A1 7/2008 Murayama et al. ..... 399/90
2008/0159775 A1 7/2008 Koishi et al. ..... 399/90

FOREIGN PATENT DOCUMENTS

JP 7-20753 1/1995
JP 9-050174 2/1997
JP 2002-372819 12/2002
JP 2003-316105 11/2003
JP 2005-107139 4/2005
JP 2006-184901 7/2006
JP 2006-259148 9/2006
JP 2006-267668 10/2006

* cited by examiner

*Primary Examiner*—Hoan Tran
(74) *Attorney, Agent, or Firm*—Fitzpatrick, Cella, Harper & Scinto

(57) ABSTRACT

An image forming apparatus has a tray, which is able to be drawn out of the apparatus and on which a plurality of cartridges of different sizes can be mounted. A cartridge, being the largest in size among a plurality of process cartridges, is detachably arranged at a location at which it is first exposed to outside when a cartridge tray is drawn out. A developer storage portion of the largest cartridge has the largest capacity and stores a developer of a black color.

17 Claims, 13 Drawing Sheets

IMAGE FORMING APPARATUS

BACKGROUND OF THE INVENTION

1. Field of the Invention

The present invention relates to an image forming apparatus having a supporting member on which a plurality of cartridges are adapted to be mounted in a detachable manner.

2. Description of the Related Art

In an image forming apparatus using an electrophotographic image forming process, there has been adopted a system in which at least one of an electrophotographic photosensitive member, a process unit acting on the electrophotographic photosensitive member, and a developer storage portion with a developer stored therein is formed into a cartridge and is detachably attached to an image forming apparatus main body. According to such a cartridge system, a user is able to perform the maintenance of the apparatus without resort to a serviceman. As a result, convenience and efficiency in operation of the apparatus can be improved to a remarkable extent. Therefore, such a cartridge system has been used in a lot of electrophotographic image forming apparatuses.

For such a detachable construction of a cartridge, there is known a system in which a cartridge being carried on a tray is drawn out for detachment and attachment thereof (see Japanese patent application laid-open No. 2006-184901 and U.S. Pat. No. 2,005,147,432).

However, in an image forming apparatus that has a drawer or tray to which a plurality of cartridges can be attached, in case where only a specific cartridge is made larger in size because of a large amount of consumption of a specific developer contained in the specific cartridge, etc., there will be a possibility that the image forming apparatus might have to be increased in size, or a waste of space might occur.

SUMMARY OF THE INVENTION

Accordingly, the object of the present invention is to provide an image forming apparatus of the type that has a supporting member, on which a plurality of cartridges of different sizes can be mounted and which is able to be drawn out, and that is able to prevent the waste of space or reduce the amount of wasted space.

Another object of the present invention is to provide an image forming apparatus which is capable of forming an image on a recording medium, and which includes: a main body frame; and a supporting member that is movable between an inner position in which the supporting member is located at an inner side of the main body frame and an outer position in which the supporting member is located at an outer side of the main body frame, and that has a mounting portion on which a first cartridge and a second cartridge are detachably mounted. The first cartridge is mounted on the most downstream side of the mounting portion in a drawing direction in which the supporting member is drawn out from the inner position to the outer position, and the second cartridge is mounted on an upstream side of the first cartridge in the drawing direction, and in a state where the first cartridge and the second cartridge are mounted on the mounting portion, and the first cartridge has a protruded portion that protrudes in a direction orthogonal to the drawing direction more than the second cartridge does.

Another object of the invention is to provide an image forming apparatus which is capable of forming an image on a recording medium, and which includes: a main body frame; and a tray that is movable between an inner position in which the supporting member is located at an inner side of the main body frame and an outer position in which the supporting member is located at an outer side of the main body frame, and that has a mounting portion on which a first cartridge and a second cartridge are detachably mounted. The first cartridge is mounted on the most downstream side of the mounting portion in a drawing direction in which the supporting member is drawn out from the inner position to the outer position, and the second cartridge is mounted on an upstream side of the first cartridge in the drawing direction, and the first cartridge is larger than the second cartridge.

The above and other objects, features and advantages of the present invention will become more readily apparent to those skilled in the art from the following detailed description of a preferred embodiment of the present invention taken in conjunction with the accompanying drawings.

DESCRIPTION OF THE EMBODIMENTS

Hereinafter, a preferred embodiment of the present invention will be described in detail while referring to the accompanying drawings. In all the figures of the following embodiment, the same symbols are attached to the same or corresponding parts or elements.

(Overall Construction of an Electrophotographic Image Forming Apparatus)

Figure 1:
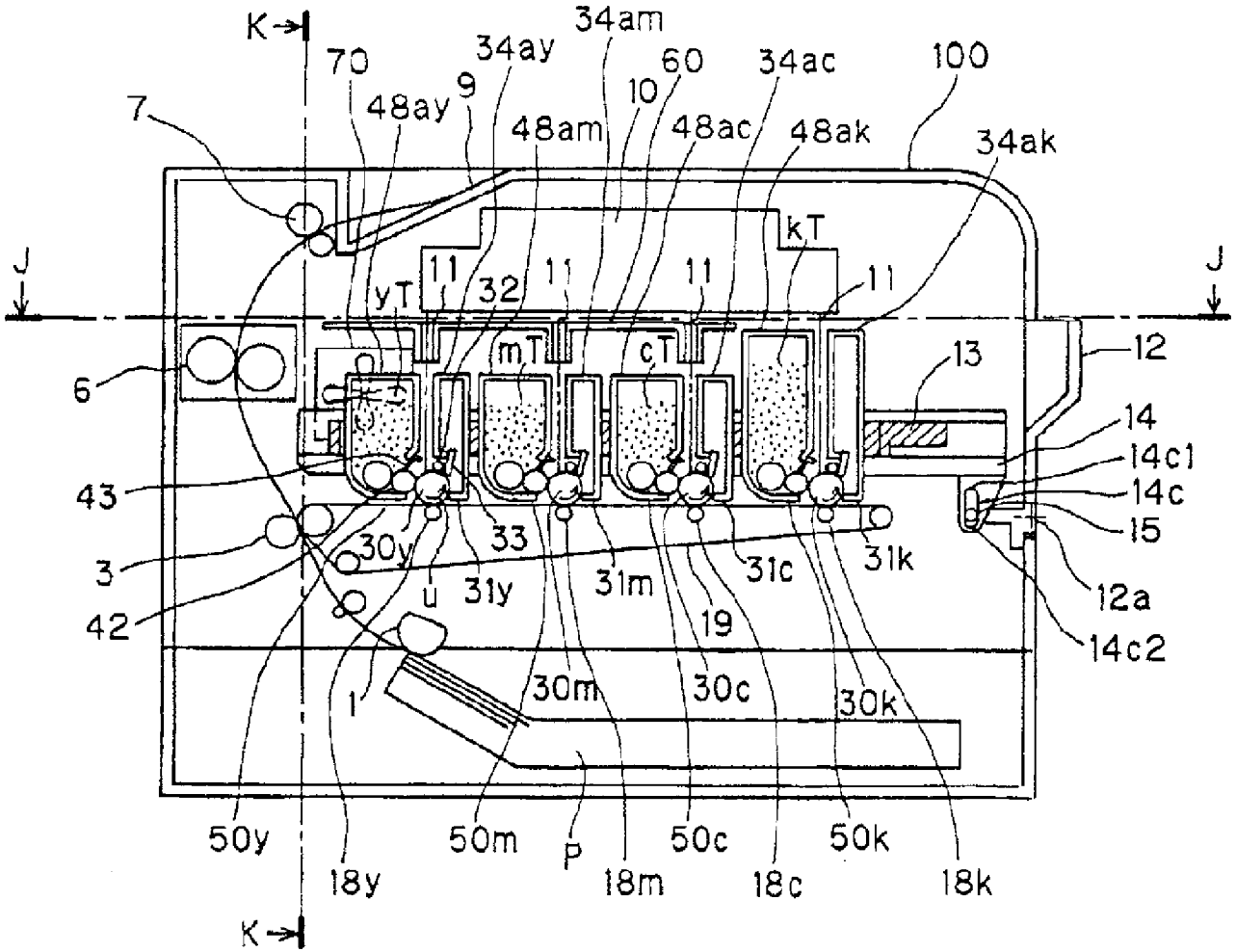
FIG. 1 is a cross sectional view showing the overall construction of an electrophotographic image forming apparatus according to one embodiment of the present invention.
Figure 2:
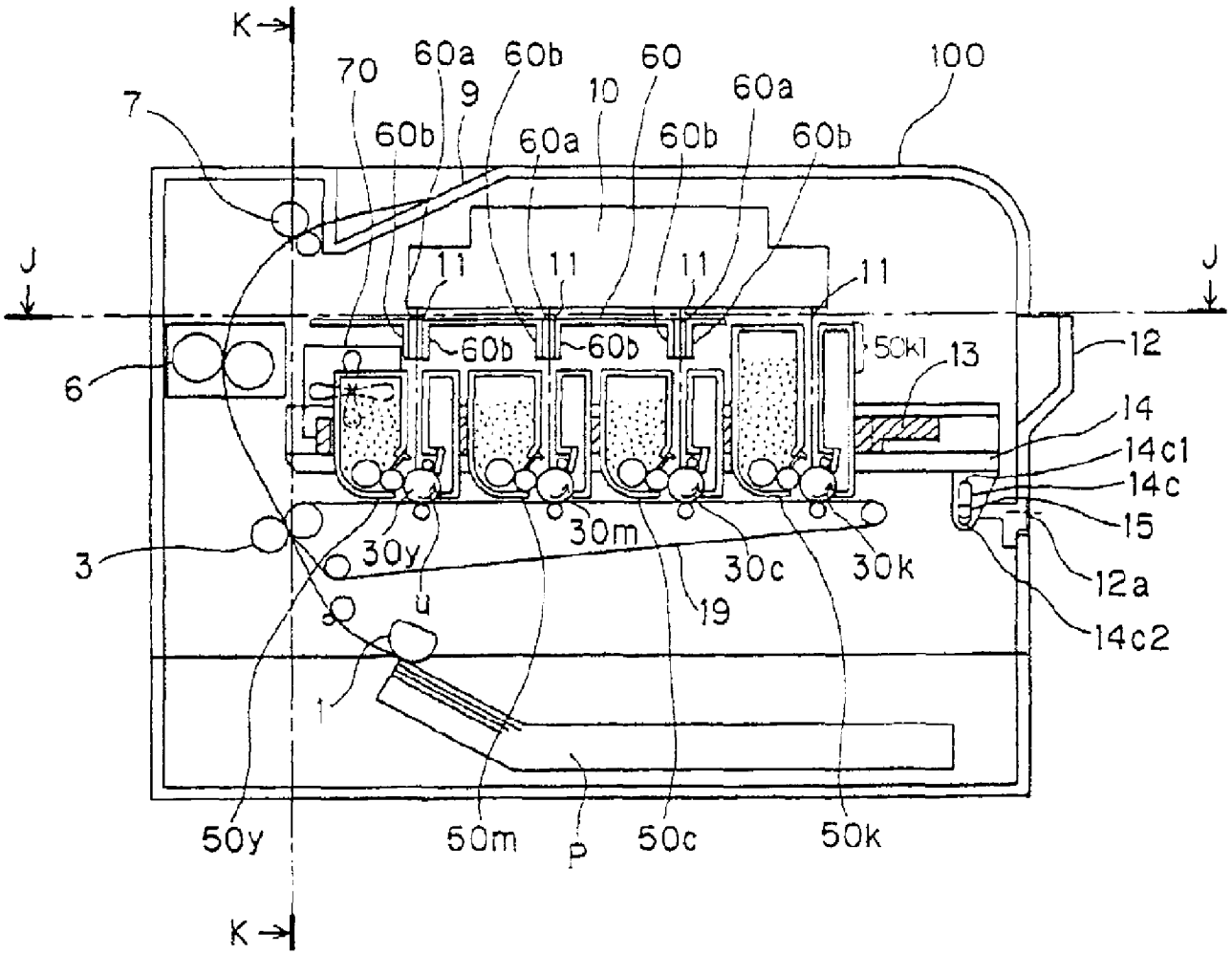
FIG. 2 is a cross sectional view showing the overall construction of an electrophotographic image forming apparatus according to the embodiment of the present invention.

First of all, reference will be made to an electrophotographic image forming apparatus which is able to form an image on a recording medium. This electrophotographic image forming apparatus is of an in-line type having a plurality of process cartridges 50 (50*y*, 50*m*, 50*c*, 50*k*) arranged in a line or row. In FIGS. 1 and 2, there is shown the electrophotographic image forming apparatus (hereinafter referred to as an apparatus main body) 100 to which the process cartridges 50 (hereinafter referred to simply as "cartridges") are attached in a detachable manner. Here, the cartridge 50*k* acting as a first cartridge has a first developer storage portion in which a toner T of a black color (kT) acting as a first developer is stored. In addition, the other cartridges 50*y*, 50*m*, 50*c* acting as second cartridges have second developer storage portions in which toners T of a yellow color (yT), a magenta color (mT) and a cyan color (cT) acting as second developers are stored, respectively.

As shown in FIG. 1, in the apparatus main body 100 acting as a main body frame, laser beams 11 irradiate, based on an image signal, the surfaces of electrophotographic photosensitive drums 30 (hereinafter referred to simply as photosensitive drums), respectively, which act as image bearing members, by means of a laser scanner 10 acting as an exposure unit. As a result, electrostatic latent images corresponding to the individual colors are formed on the individual photosensitive drums 30 (30*y*, 30*m*, 30*c*, 30*k*), respectively. These electrostatic latent images are developed by individual developing rollers 42, respectively, to form developer images in the form of toner images on the surfaces of the photosensitive drums 30, respectively. By impressing voltages on transfer rollers 18*y*, 18*m*, 18*c*, 18*k*, the toner images of the individual colors formed on the individual photosensitive drums 30 are sequentially transferred onto a transfer surface of a transfer unit (an intermediate transfer member) in the form of an intermediate transfer belt 19 along a drawing direction in which a tray 13 as a supporting member is drawn out. As a result, the toner images of the individual colors are superposed or overlapped with one another on the intermediate transfer belt 19.

Figure 6:
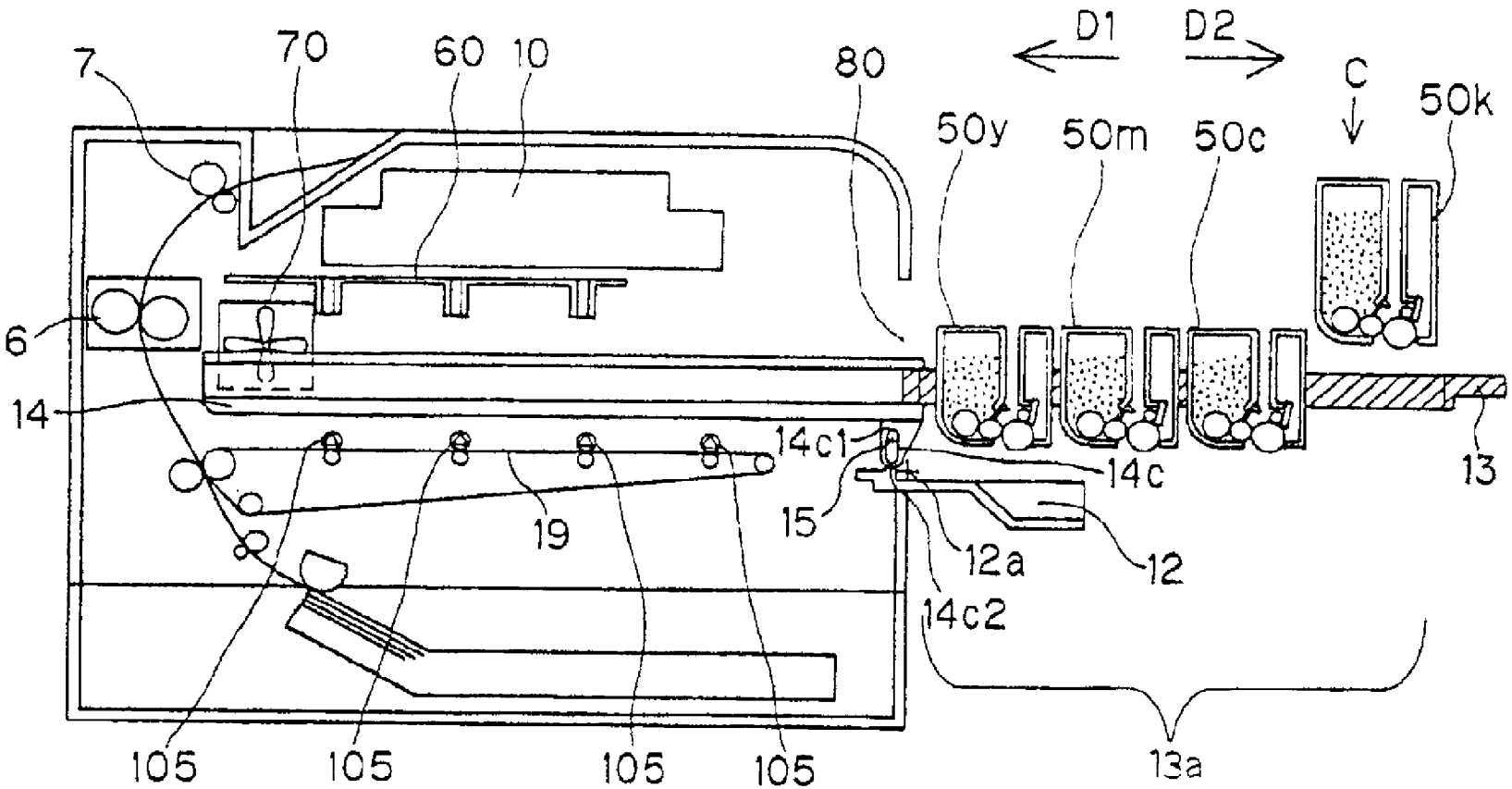
FIG. 6 is a cross sectional view showing a process cartridge being attached and detached in the electrophotographic image forming apparatus according to the embodiment of the present invention.

Thereafter, the toner images formed on the intermediate transfer belt 19 are transferred by transfer rollers 3 onto a recording medium P that is carried by a feed unit in the form of a feed roller 1 at a most upstream side of the intermediate transfer belt 19 in the drawing direction of the tray 13 (in the direction of arrow D2 in FIG. 6). Thereafter, the recording medium P is conveyed to a fixing unit in the form of a fixing device 6 that is composed of a driving roller and a fixing roller with a heater incorporated therein. Here, note that the fixing device 6 is arranged at a location upstream of the tray 13 in the drawing direction thereof. Then, the fixing device 6 heats and applies pressure on the recording medium P on which the toner images have been transferred, whereby the toner images are fixed to the recording medium P. After that, the recording medium P with the toner images fixed thereon is discharged to a discharge unit in the form of a discharge tray 9 by means of a pair of discharge rollers 7.

(Overall Construction of the Process Cartridges)

Figure 3:
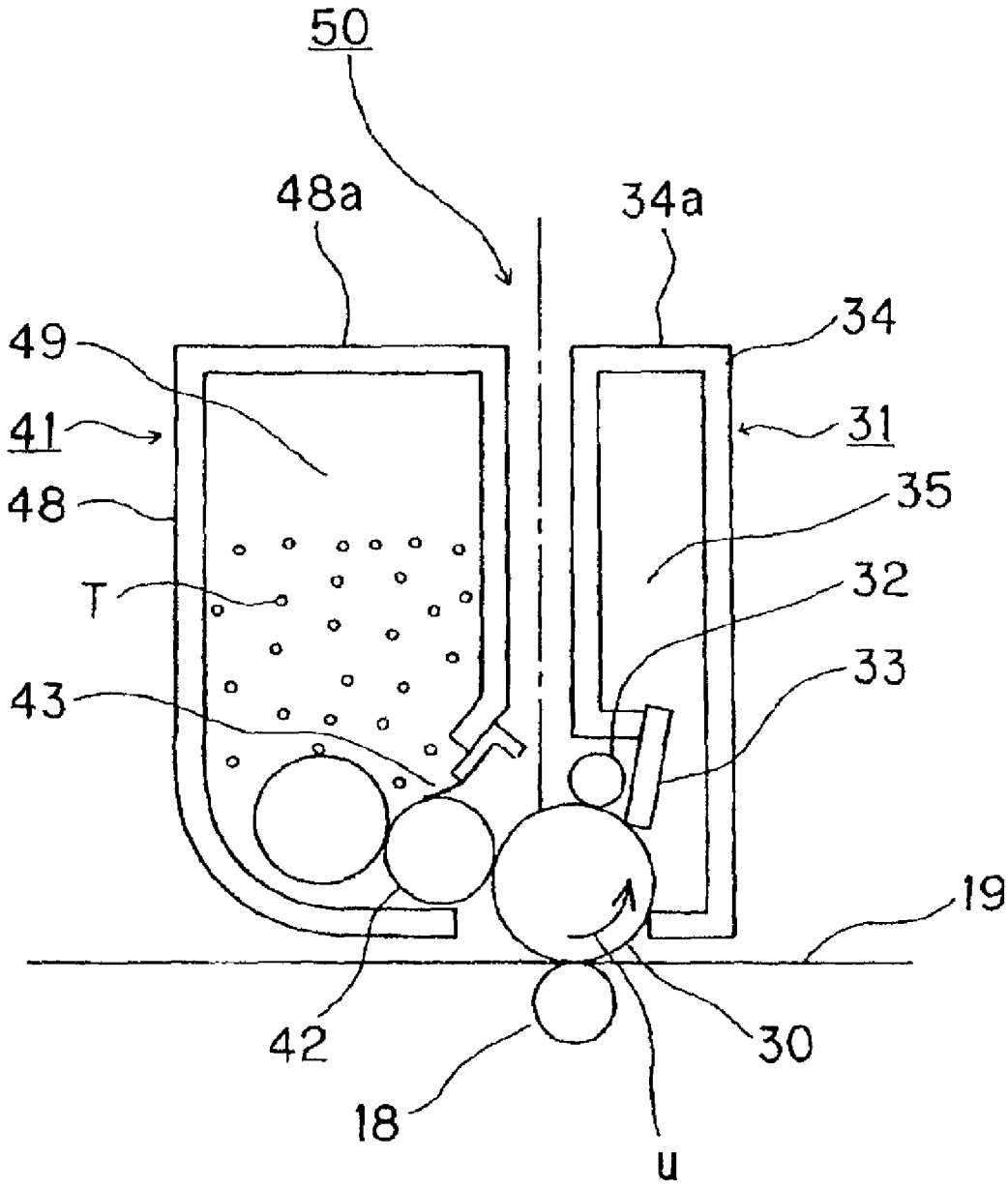
FIG. 3 is a cross sectional view showing a process cartridge according to the embodiment of the present invention.
Figure 4:
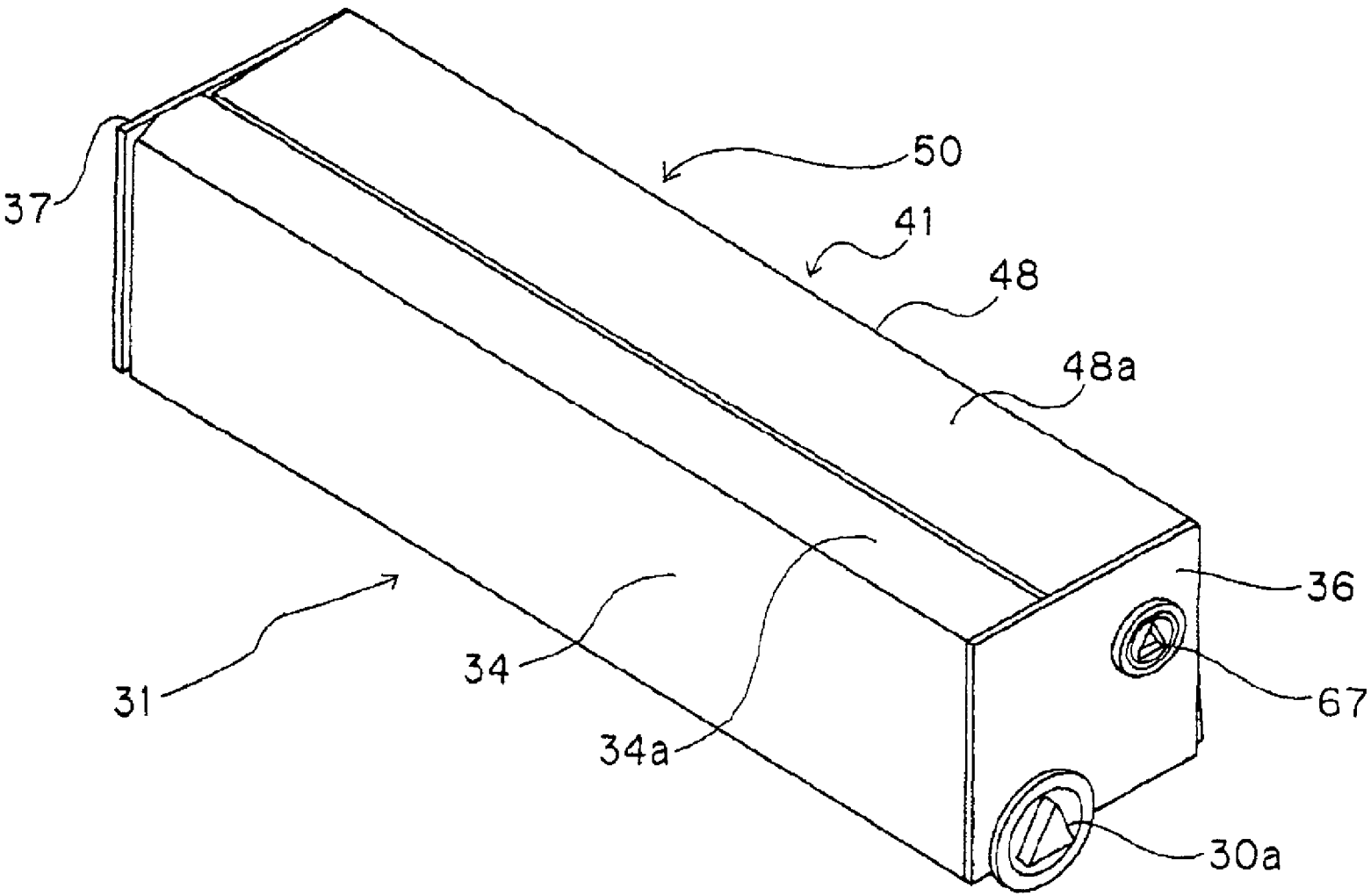
FIG. 4 is a perspective view showing the process cartridge according to the embodiment of the present invention.
Figure 5:
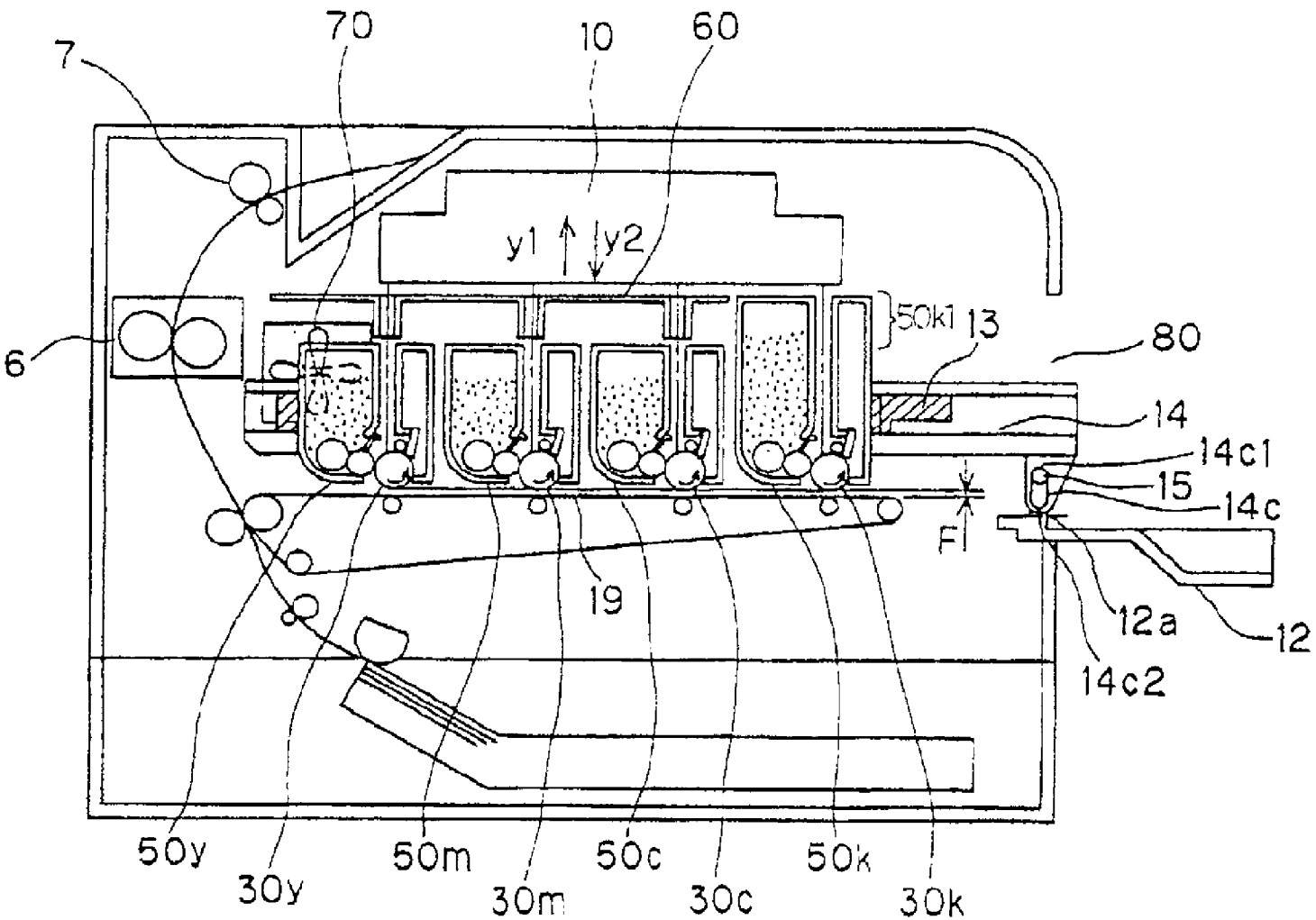
FIG. 5 is a cross sectional view showing the overall construction of the electrophotographic image forming apparatus in which a door is opened for drawing out a tray, according to the embodiment of the present invention.

Next, reference will be made to the cartridges 50 (50*y*, 50*m*, 50*c*, 50*k*) according to this embodiment. The cartridges according to this embodiment are shown in FIG. 3 and FIG. 4. In addition, the states of the cartridges 50 when they are attached and detached to the apparatus main body 100 are shown in FIG. 5 and FIG. 6, respectively. In this embodiment, a process cartridge will be described as one form of the cartridges. Here, the process cartridge is a cartridge in which a charging unit, a developing unit, an electrophotographic photosensitive member, and so on are integrally formed into a single unit, and which is constructed in such a manner that it can be attached and detached to the image forming apparatus main body.

As shown in FIG. 3, toners yT, mT, cT, kT of different colors are stored in the cartridges 50*y*, 50*m*, 50*c*, 50*k*, respectively. In addition, the cartridge 50*k* is of the same construction as the other cartridges 50*y*, 50*m*, 50*c* except for the kind of its toner to be stored therein and the size of its toner storage portion (developer storage portion). Accordingly, in the following description, the construction of the interior of that cartridge will be described by using the other cartridges 50*y*, 50*m*, 50*c*. Here, note that those of the black cartridge 50*k* which are different from the other cartridges will be described later.

The cartridges 50 are each provided with a photosensitive drum 30 and a developer image forming unit in the form of a process unit acting on a corresponding photosensitive drum 30. Here, note that the process unit indicates a charging unit 32, a developing roller 42, a toner storage portion 49, a cleaning unit 33, a waste toner storage portion 35 and so on.

The charging units 32 serve to charge the corresponding photosensitive drums 30, respectively. The developing rollers 42 serve to develop the latent images formed on the corresponding photosensitive drums 30, respectively. The toner storage portions 49 acting as the developer storage portions receive toners T for developing the latent images, respectively. The cleaning units 33 serve as toner removing units for removing and cleaning the residual toners that remain on the surfaces of the corresponding photosensitive drums 30, respectively. The waste toner storage portions 35 serve to receive and store the corresponding residual toners, respectively.

Each of the cartridges 50 has a first unit 31 and a second unit 41.

(Construction of the First Unit)

Now, the first unit 31 will be described. The first unit 31 has a photosensitive drum 30, a charging unit 32, a cleaning unit 33, a drum frame 34, and a waste toner storage portion 35, as shown in FIG. 3.

As shown in FIG. 4, the photosensitive drum 30 has one longitudinal end thereof rotatably supported by a cover member 36 (such an arrangement being similar in the case of a developing roller 42). On the other hand, the photosensitive drum 30 has the other longitudinal end thereof rotatably supported by a cover member 37. These cover members 36, 37 are fixedly secured to drum frame 34 at the opposite longitudinal ends of the drum frame 34.

In addition, a coupling member 30*a* for transmitting a driving force to the photosensitive drum 30 is arranged at one longitudinal end of the photosensitive drum 30. This coupling member 30*a* is placed into engagement with a first main body coupling member 105 when the cartridge 50 is attached to the apparatus main body 100, as shown in FIG. 6. A driving force is transmitted from a drive motor (not shown) mounted on the apparatus main body 100 to the coupling member 30*a*, so that the photosensitive drum 30 is thereby driven to rotate in the direction of arrow u, as shown in FIG. 1 and FIG. 3.

Also, the charging unit 32 is supported by the drum frame 34 in such a manner that it can be driven to rotate following the rotation of the photosensitive drum 30 while being in contact therewith. The cleaning unit 33 is supported by the drum frame 34 in such a manner that it is placed into abutment with the circumferential surface of the photosensitive drum 30 by a predetermined pressure.

(Construction of the Second Unit)

Next, the second unit 41 will be described. As shown in FIG. 3, the second unit 41 has a developing roller 42, a developing blade 43, and a developing frame body 48. The developing frame body 48 has a toner storage portion 49 that stores a toner supplied to the developing roller 42, and a developing blade 43 that restricts the layer thickness of the toner on the circumferential surface of the developing roller 42. In addition, as shown in FIG. 4, in order to drive the developing roller 42 to rotate, a coupling member 67 being driven from the apparatus main body 100 is arranged at one end of the developing roller 42. Here, note that the toner storage portion 49 corresponds to a developer storage portion (i.e., a first developer storage portion in case of the cartridge 50*k*, and a second developer storage portions in case of the other cartridges 50*y*, 50*m*, 50*c*).

(Drawing Out from the Image Forming Apparatus Main Body)

Next, a drawing member in the form of a cartridge tray 13 (hereinafter referred to simply as a "tray") will be described.

The tray 13 is movable in one direction of D1 (the direction of pushing) and in the other direction of D2 (the direction of drawing) with respect to the apparatus main body 100, as shown in FIG. 6. That is, the tray 13 is arranged in such a manner that it can be drawn out and pushed in. The tray 13 is movable substantially in a horizontal direction. In addition, the tray 13 is movable among an image forming position in the apparatus main body 100 (see FIGS. 1 and 2), an inner spaced-apart position that is apart from the intermediate transfer belt 19 in the interior of the apparatus main body 100 (see FIG. 5), and a drawn-out position (outer position) in which it is drawn out from an attachment or mounting position thereof to the apparatus main body 100 (see FIG. 6). In particular, in this embodiment, the above-mentioned image forming position, the above-mentioned inner spaced-apart position, and intermediate positions between these positions are generally called pushed-in positions (inner position). Here, note that the tray 13 has a mounting portion 13*a* to which the plurality of cartridges 50 (50*y*, 50*m*, 50*c*, 50*k*) can be mounted or attached (see FIG. 6).

Each of the cartridges 50 is detachably fitted or attached to the mounting portion 13*a* along a direction of arrow C with the tray 13 being located in the drawn-out position, as shown in FIG. 6. In this manner, the tray 13 serves to support the individual cartridges 50.

The individual cartridges 50 being placed in the mounting portion 13*a* are caused (pushed) to come into the apparatus main body 100 together with the tray 13. At this time, as shown in FIG. 5, the cartridges 50 are moved in a state where the transfer member in the form of the intermediate transfer belt 19 arranged thereunder and the photosensitive drums 30 are kept apart a predetermined distance F from each other. That is, the cartridges 50 are moved along a direction parallel to the transfer surface of the intermediate transfer belt 19. As a result, the tray 13 is moved up to the inner spaced-apart position (pushed-in position).

Thereafter, when a door 12 is closed, the cartridges 50 are positioned in place with respect to the apparatus main body 100. That is, the tray 13 is moved up to the image forming position (pushed-in position). Thus, it is possible to improve user operability in comparison with the case where the cartridges 50 are individually fitted or attached to the inner side of the apparatus main body 100 independently or separately from one another.

Figure 7:
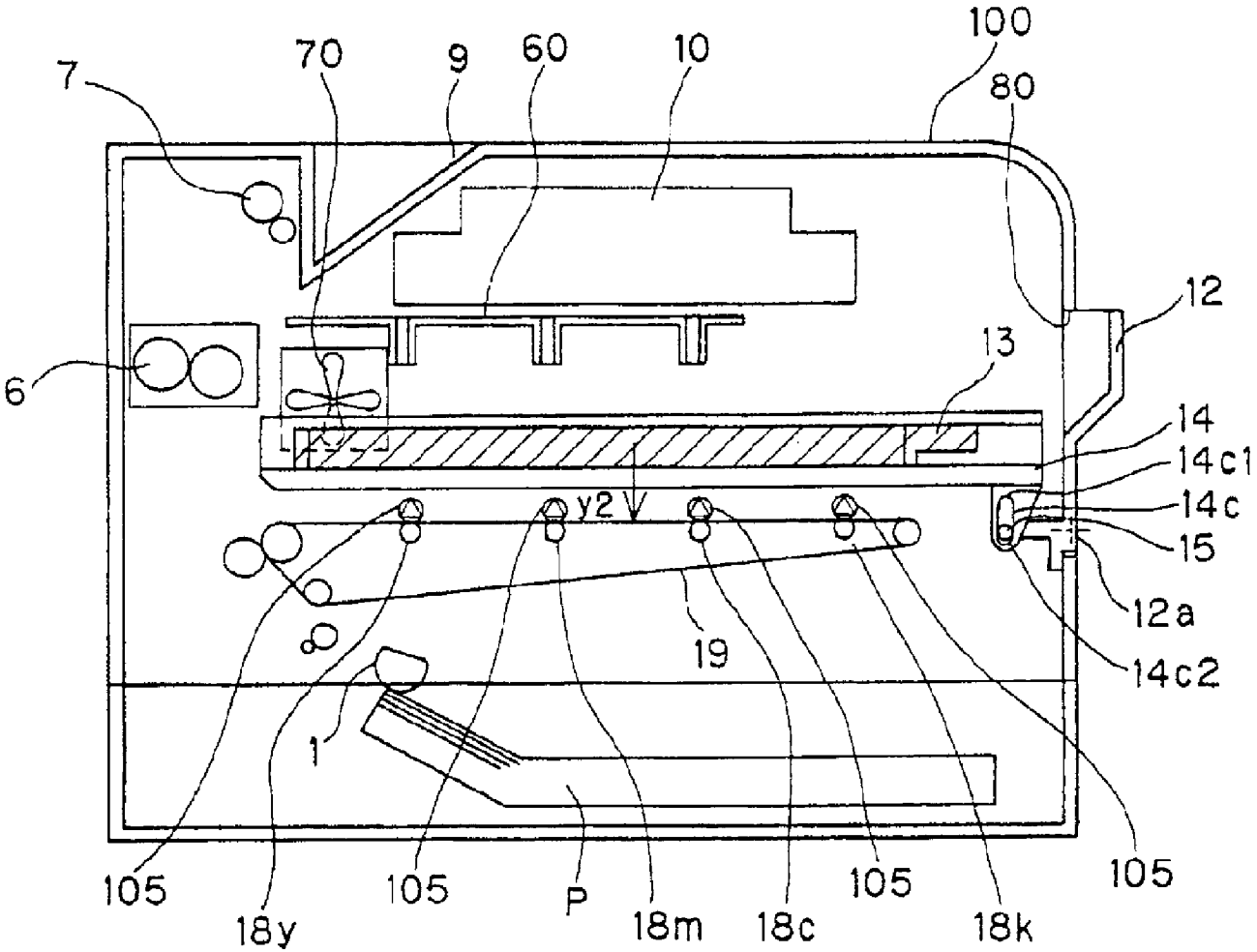
FIG. 7 is a cross sectional view showing the overall construction of the electrophotographic image forming apparatus in which a tray holding member and a tray exist inside with a door closed, according to the embodiment of the present invention.
Figure 8:
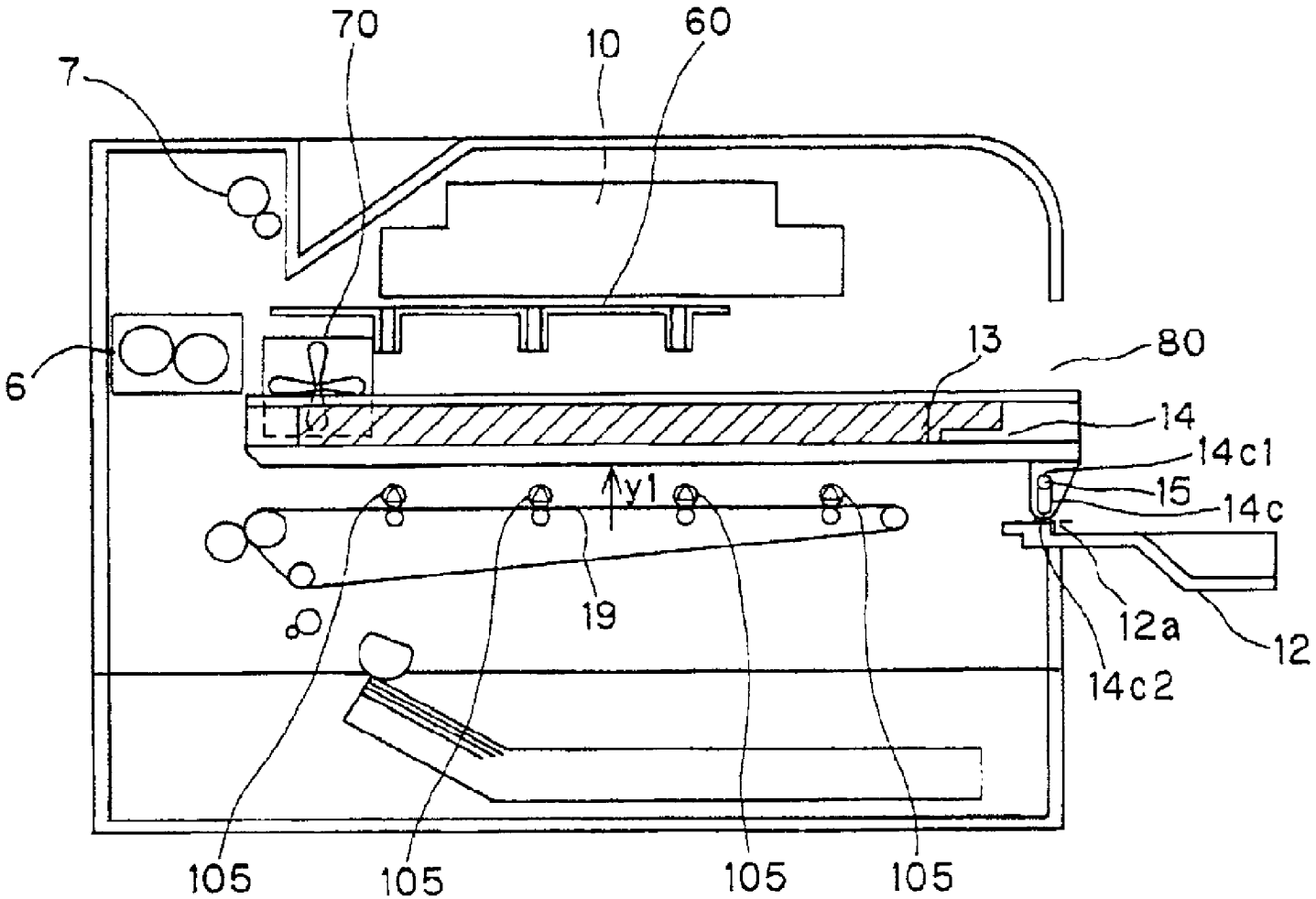
FIG. 8 is a cross sectional view showing the overall construction of the electrophotographic image forming apparatus in which the tray holding member with the tray held therein is drawn out with the door opened, according to the embodiment of the present invention.
Figure 9:
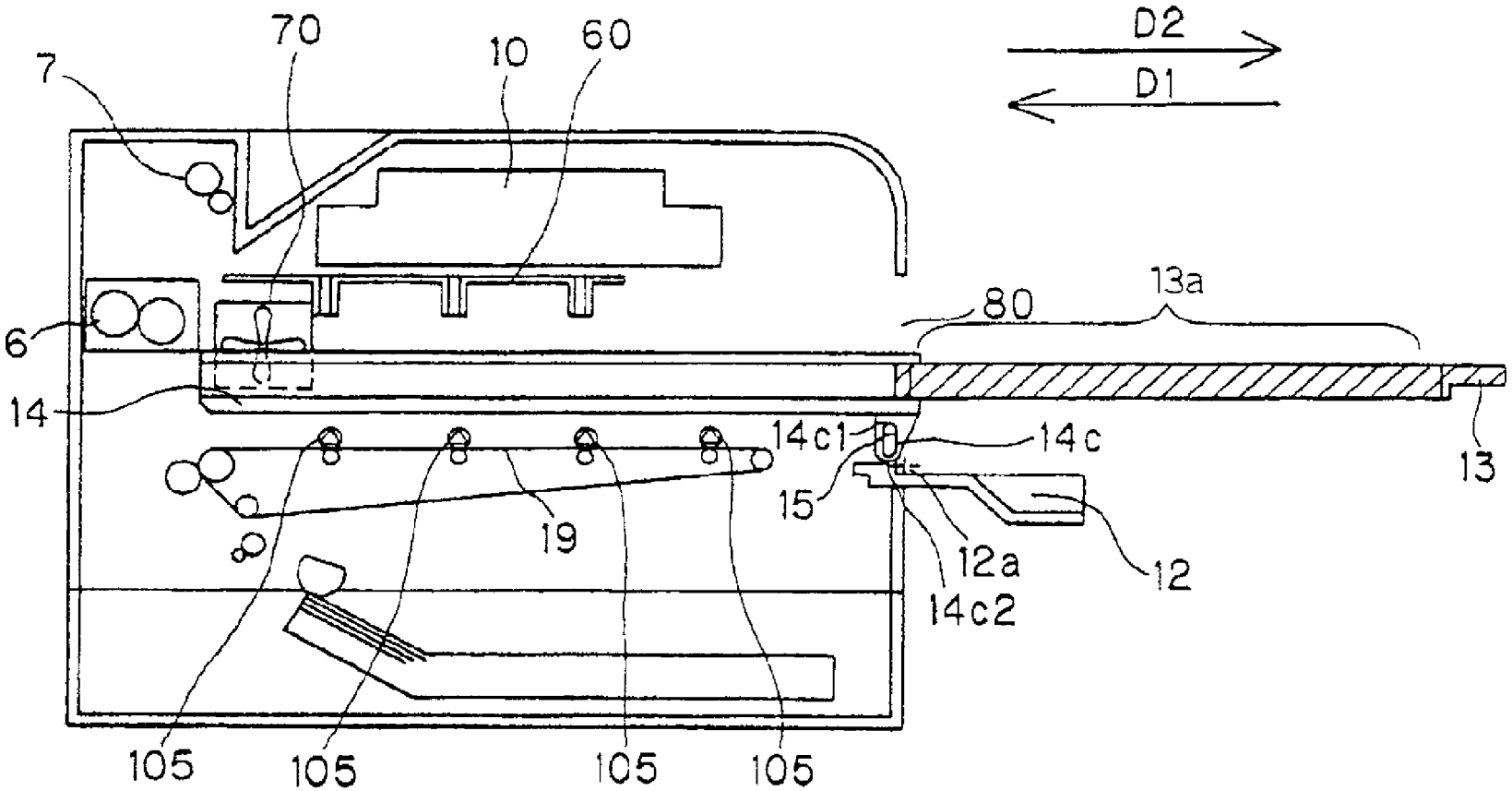
FIG. 9 is a cross sectional view showing the overall construction of the electrophotographic image forming apparatus in which the tray is drawn out from the tray holding member, according to the embodiment of the present invention.

Now, the operation of the tray 13 will be described below. In the following description, the explanation and illustration of the cartridges will be omitted for the easy and clear understanding of the operation of the tray 13. The operation of the tray 13 is shown in FIGS. 7, 8 and 9.

The tray 13 is supported by a tray holding member 14 in such a manner that it can be drawn out with respect to the tray holding member 14. This tray holding member 14 is operated in association with the motion of the door 12, which acts as an opening and closing member. The door 12 is attached to the apparatus main body 100 for rotation about an axis of rotation 12*a*. The door 12 is constructed such that it is rotatable between a closed position in which it closes an opening 80, as shown in FIG. 7, and an open position in which it opens the opening 80, as shown in FIG. 8.

Figure 12:
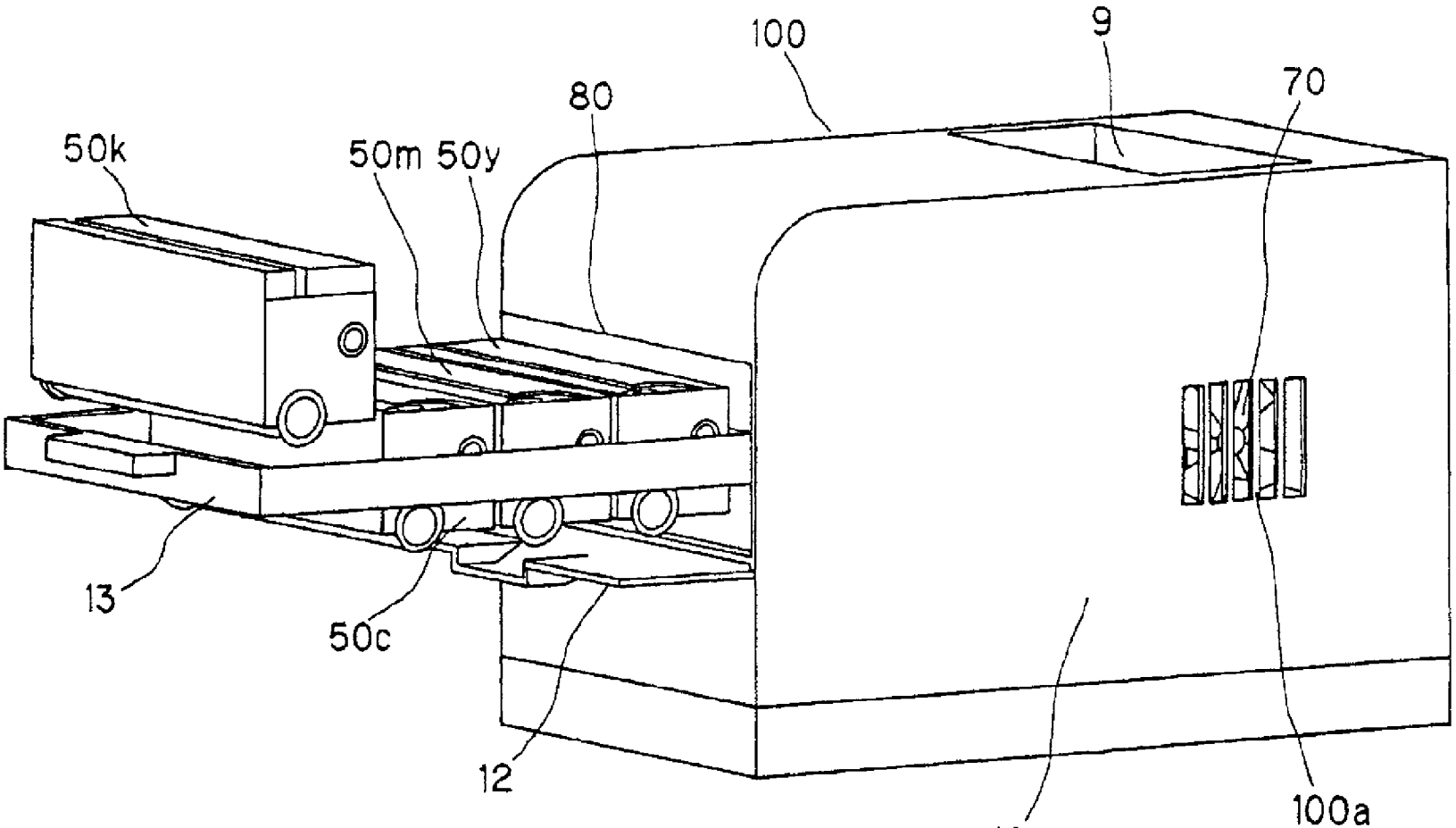
FIG. 12 is a perspective view showing the overall construction of the electrophotographic image forming apparatus in which the tray with process cartridges attached thereto is drawn out, according to the embodiment of the present invention.

Next, reference will be made to the case where the cartridges fitted to the apparatus main body 100 are taken out. First of all, the door 12 is caused to rotate from the closed position to the open position. In accordance with the rotation of the door 12, an engagement portion 15 formed on the door 12 is moved to rotate about the axis of rotation 12*a* in a clockwise direction in FIG. 7. As a result, as shown in FIG. 8, the engagement portion 15 is caused to move an elongated hole 14*c* formed in the tray holding member 14 from its lower end 14*c*2 to its upper end 14*c*1. In accordance with the movement of the engagement portion 15, the tray holding member 14 is forced to move in a direction away from the intermediate transfer belt 19 (i.e., in the direction of arrow y1 in FIG. 8), and, as shown in FIG. 9, in this state, the tray holding member 14 is moved through the opening 80 in the direction of arrow D2 in this figure, so that it is drawn out to the outside of the apparatus main body 100. A perspective view in the state at this time is shown in FIG. 12.

Now, reference will be made to the case where the cartridges 50 are fitted or attached to the apparatus main body 100. As shown in FIG. 9, in a state where the door 12 is located in the open position, the tray 13 is caused to move so as to pass the opening 80 in the direction of arrow D1, whereby it is pushed (moved) into the apparatus main body 100. After that, the door 12 is forced to rotate up to the closed position, as shown in FIG. 7. In accordance with the rotation of the door 12, the engagement portion 15 formed on the door 12 is moved to rotate about the axis of rotation 12*a* in the counterclockwise direction. As a result, as shown in FIG. 7, the engagement portion 15 is caused to move in the elongated hole 14*c* formed in the tray holding member 14 from its upper end 14*c*1 to its lower end 14*c*2. In accordance with this movement, the engagement portion 15 operates to move the tray holding member 14 in a direction toward the intermediate transfer belt 19 (i.e., in the direction of arrow y2 in FIG. 7). In this manner, the cartridges 50 are positioned in place with respect to the apparatus main body 100.

(Attachment of the Process Cartridges to the Apparatus Main Body)

Next, reference will be made to the operation of attaching the cartridges 50 (50*y*, 50*m*, 50*c*, 50*k*) to the apparatus main body 100.

As shown in FIG. 6, the cartridges 50 are fitted or attached to the tray 13 (more specifically, its mounting portion 13*a*), which has been drawn out to its drawn-out position, along the direction of arrow C. Then, by moving the tray 13 in the direction of arrow D1, the cartridges 50 are forced to come into the apparatus main body 100 through the opening 80.

In this embodiment, the cartridges 50 are forced to move into the apparatus main body 100 in a direction substantially perpendicular to the axial direction of the photosensitive drums 30 (the developing rollers 42).

Here, as shown in FIG. 1, the black cartridge 50*k* is detachably attached to the most downstream side of the mounting portion 13*a* in the drawing direction of the tray 13. Then, the other cartridges 50*y*, 50*m*, 50*c* are also detachably attached to the mounting portion 13*a* at locations upstream of the cartridge 50*k*. An upper surface portion 48*ak* of the developing frame body 48 in this cartridge 50*k* has a space or distance to the laser scanner 10 which is narrower in comparison with those of upper surface portions 48*ay*, 48*am*, 48*ac* of the developing frame bodies 48 in the cartridges 50*y*, 50*m*, 50*c*, respectively. That is, it is constructed such that the distance of the cartridge 50*k* to the laser scanner 10 in the direction away from the intermediate transfer belt 19 (i.e., in a direction substantially perpendicular to the drawing direction of the tray 13) is the narrowest in comparison with those of the other cartridges 50*y*, 50*m*, 50*c*. The toner storage portion 49 of the cartridge 50*k* becomes larger in comparison with each of the toner storage portions 49 of the other cartridges 50*y*, 50*m*, 50*c*. Accordingly, the first cartridge in the form of the cartridge 50*k* storing the toner of a black color has a toner capacity larger in comparison with those of the other second cartridges 50*y*, 50*m*, 50*c* (containing toners other than the black toner).

Here, note that as a method of making the capacity for the black toner larger than those for the toners of the other colors, it is possible to adopt another method of enlarging the width of the black toner storage portion in the developing frame body 48 to the right and left direction (the drawing direction) in FIG. 1. However, according to this embodiment, the distance between the photosensitive drum 30*k* and the photosensitive drum 30*c* can be decreased as compared with the method of enlarging the width of the black toner storage portion in the drawing direction, thus making it possible to reduce the size or dimensions of the apparatus main body 100. In addition, according to this embodiment, a color shift (color registration shift or deviation) between images of plural colors can be decreased as compared with the method of enlarging the width of the black toner storage portion in the drawing direction, thereby making it possible to obtain high image quality. This is because the intervals between the plurality of photoreceptors drums 30 can be made equal.

Similarly, an upper surface portion 34*ak* of the drum frame 34 in the cartridge 50*k* also has a space or distance to the laser scanner 10 which is narrower in comparison with those of upper surface portions 34*ay*, 34*am*, 34*ac* of the drum frames 34 in the cartridges 50*y*, 50*m*, 50*c*, respectively. As a result, it is possible to deal with an increase in the amount of waste toner due to an increase in the capacity of the black toner. That is, in the waste toner storage portion 35 of the cartridge 50*k*, too, the capacity thereof is intended to be increased in a similar manner as in the capacity increase of the corresponding toner storage portion. In this case, in order to prevent the enlargement of the apparatus main body 100 while making distances between mutually adjacent photosensitive drums 30 equal to one another, it is constructed such that the size of the waste toner storage portion 35 is not increased in the horizontal direction of FIG. 1. In addition, as a modification of this embodiment, the developing frame body of the cartridge 50*k* and those of the other cartridges 50*y*, 50*m*, 50*c* may be made different in shape from each other, but the drum frame 34 of the cartridge 50*k* and those of the other cartridges 50*y*, 50*m*, 50*c* may be made into the same shape. That is, the height of the upper surface portion 34*ak* may be made identical to the height of the upper surface portions 34*ay*, 34*am*, 34*ac*. With such a modification, it becomes possible to reduce the cost of the drum frames 34 as a whole, while achieving the above-mentioned advantageous effects except for an advantageous effect of the increased amount of the waste toner.

In this embodiment, as compared with the other cartridges 50*y*, 50*m*, 50*c*, the cartridge 50*k* has a protruded portion 50*k*1 protruding in a direction orthogonal to the drawing direction. More specifically, the cartridge 50*k* has the protruded portion 50*k*1 that protrudes in a direction orthogonal with respect to both the drawing direction and the axial direction of the developing roller 42, as compared with the other cartridges 50*y*, 50*m*, 50*c*. The protruded portion 50*k*1 constitutes a part of the toner storage portion 49 of the cartridge 50*k*. As a result, the service life of the black cartridge 50*k* can be extended, so the frequency of replacement thereof can be decreased. In addition, with such a construction, the space upstream of the protruded portion 50*k*1 in the drawing direction can be effectively made use of, so the space efficiency of the entire image forming apparatus can be improved. Moreover, the protruded portion 50*k*1 can be formed to protrude in the axial direction of the developing roller 42, but in this embodiment, the protruded portion 50*k*1 is constructed such that it protrudes only in the orthogonal direction which is orthogonal with respect to both the drawing direction and the axial direction of the developing roller 42. With such a construction, surroundings of the tray 13 can be made simpler in construction, as compared with the case in which the protruded portion would be formed to protrude in the axial direction of the developing roller 42. Further, in this embodiment, it is possible to decrease the distance by which the tray 13 is drawn out, in comparison with the construction in which the size of the cartridge 50*k* is increased in the drawing direction. Therefore, the usability thereof can be improved according to this embodiment.

In addition, as shown in FIGS. 1 and 2, in this embodiment, the black cartridge 50*k* having the largest toner capacity and the most weight is attached to the most downstream (outer) side of the mounting portion 13*a* along the drawing direction. As a consequence, in case where the black cartridge 50*k* is replaced with a new one, the cartridge 50*k* can be first exposed to the outside upon drawing out the tray 13.

Therefore, it becomes unnecessary for drawing out the tray 13 from the apparatus main body 100 up to a whole color replacement position in which all the cartridges are exposed, as shown in FIG. 6. That is, the tray 13 need only be drawn out to a position in which only the cartridge 50*k* can be replaced with a new one, so it becomes easy to replace the black cartridge 50*k*, which has to be replaced at a relatively high frequency.

(Air Stream Restriction Plate)

Figure 10:
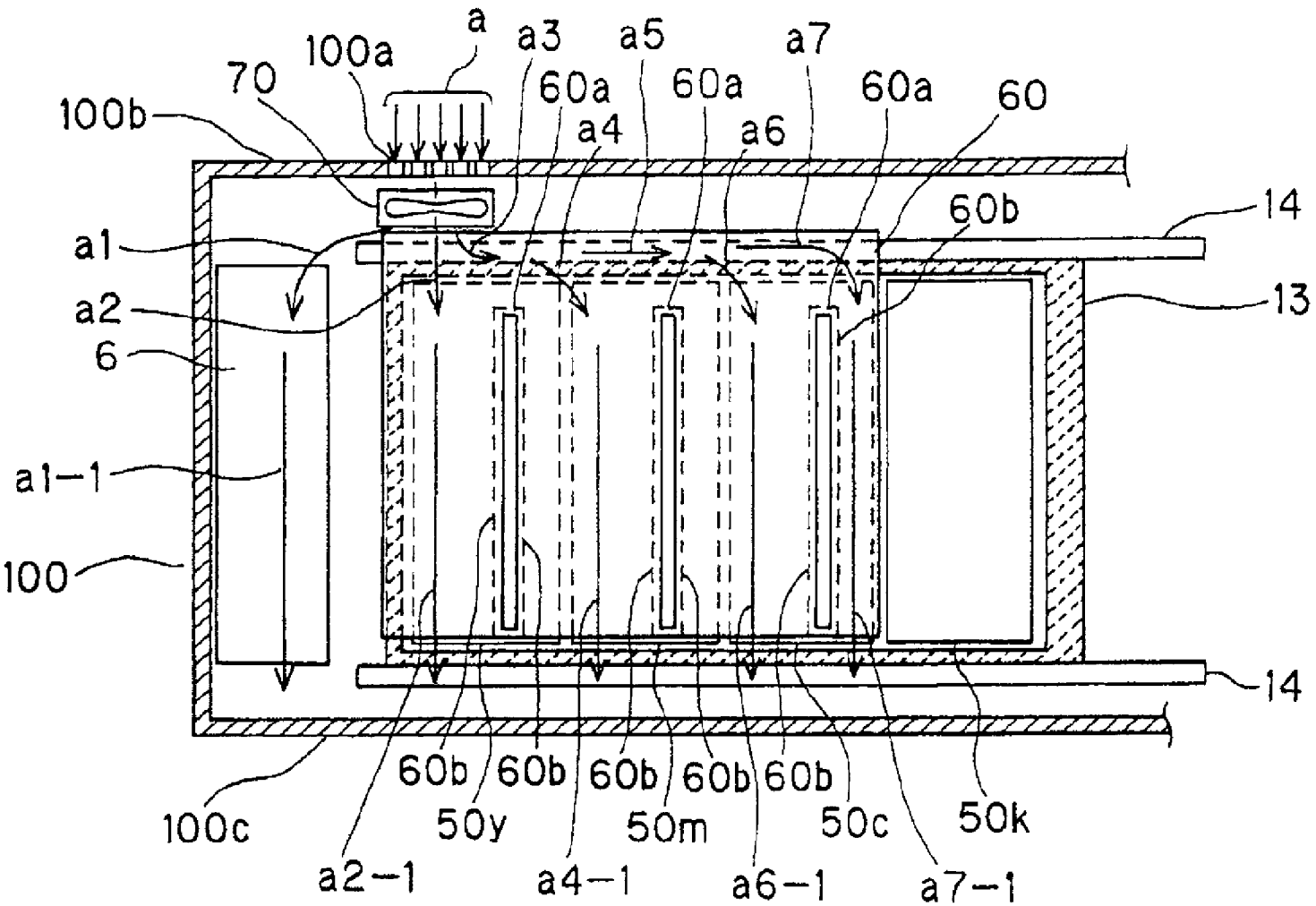
FIG. 10 is a cross sectional view, along a J-J line, of the electrophotographic image forming apparatus shown in FIG. 1.
Figure 11:
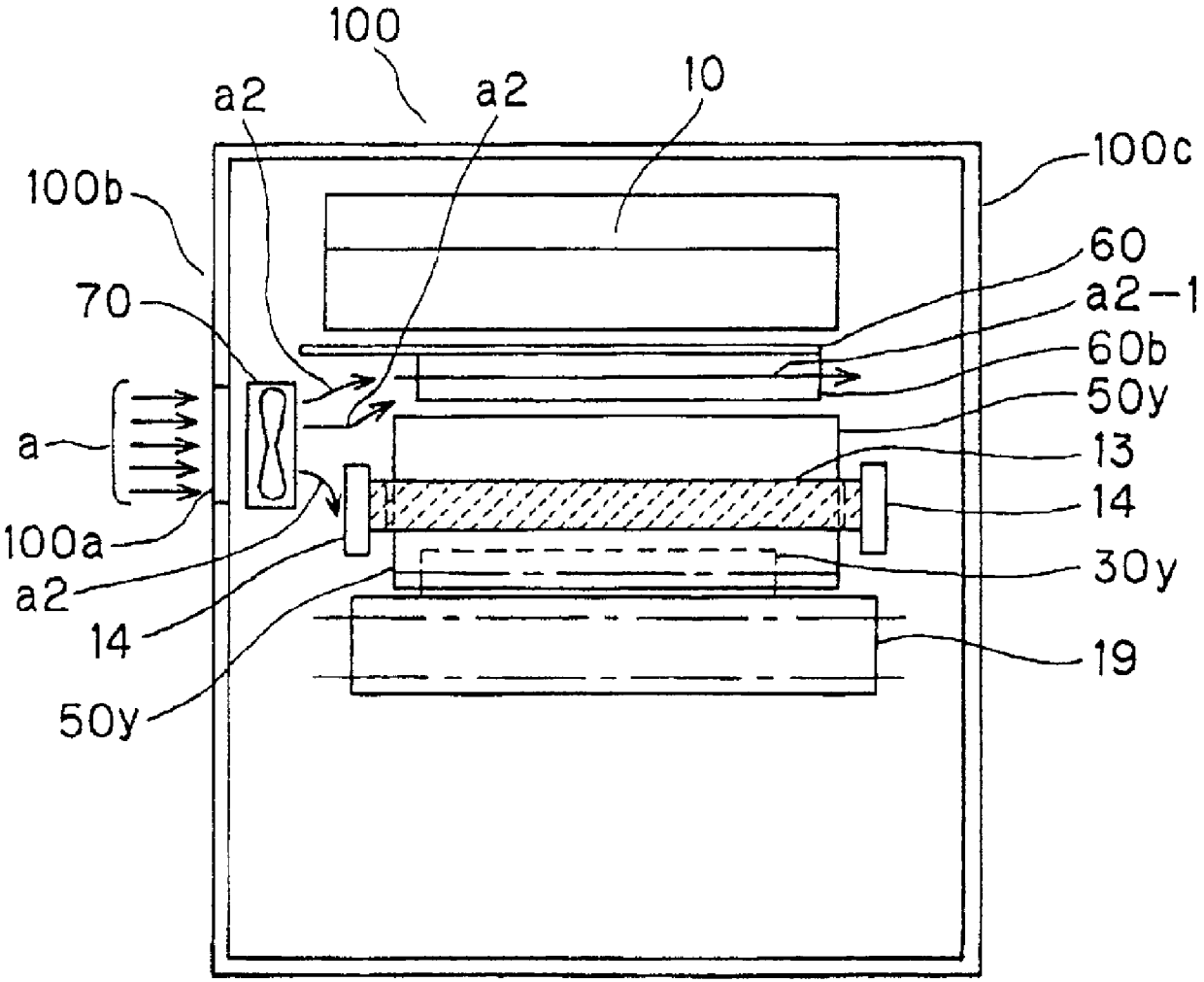
FIG. 11 is a cross sectional view, along a K-K line, of the electrophotographic image forming apparatus shown in FIG. 1.

In order to make use of gaps between the laser scanner 10 and the upper surface portions 48*ay*, 48*am*, 48*ac* of the cartridges 50*y*, 50*m*, 50*c* so as to prevent a temperature rise in the apparatus main body 100 (i.e., in the main body frame), an air stream restricting plate 60 that acts as a restriction unit for restricting an air stream is fixed in the apparatus main body 100. Here, note that the air stream restricting plate 60, as the restriction unit can be called is a fixed member which is fixedly arranged inside the apparatus main body 100 (the main body frame). Here, the air stream restricting plate 60 is constructed such that at least part thereof overlaps with at least part of the protruded portion 50*k*1, as viewed in the drawing direction. This air stream restricting plate 60 will now be described in detail. FIG. 10 shows a cross sectional view along a line J-J in FIG. 1, and FIG. 11 shows a cross sectional view along a line K-K in FIG. 1.

First of all, as elements and factors that raise the temperature in the apparatus main body 100, there exist the fixing device 6, the laser scanner 10, the rotations of the developing rollers 42 and the photosensitive drums 30 in the cartridges 50, and so on. When the temperature in the apparatus main body 100 reaches a predetermined temperature or above due to the influence of these elements and factors, the toners in the cartridges 50 adhere thereto. In addition, displacements in the mounting portion of the laser scanner 10 and cartridge positioning portions in the apparatus main body 100 can occur due to heat generated therein. Because of such displacements, it will become difficult to form an image on a recording material or medium exactly. Accordingly, a fan 70 is arranged in the apparatus main body 100 for preventing a temperature rise therein.

This embodiment is constructed such that the single fan 70 is arranged among the fixing device 6, the laser scanner 10 and the cartridges 50, all of which are temperature raising elements, whereby these components can be cooled in an efficient manner with the use of the least possible number of fans.

This fan 70 operates to rotate so as to blow air into the apparatus main body 100. As a result, as shown in FIG. 12, outside air is taken into the apparatus main body 100 from a louver 100*a* that is arranged on a right side wall thereof, as viewed in the drawing direction of the tray 13.

As shown in FIG. 10, the outside air a, blown into the apparatus main body 100 by means of the fan 70, passes through an air path or passage a1, for cooling of the fixing device 6, so that it cools the fixing device 6 in an air passage a1-1. In addition, the outside air a also passes through an air passage a2 that serves to insulate the yellow cartridge 50*y* and the laser scanner 10 from heat, so that it cools the yellow cartridge 50*y* in an air passage a2-1. Also, a part of branched outside air a3 passes through an air passage a4 that serves to insulate the magenta cartridge 50*m* and the laser scanner 10 from heat, so that it cools the magenta cartridge 50*m* in an air passage a4-1. Further, outside air a5 branches into a pair of air passages a6, a7 which serve to cool the cyan cartridge 50*c* and insulate the cyan cartridge 50*c* and the laser scanner 10 from the heat, so that it is forced to flow into a pair of air passages a6-1, a7-1.

Thereafter, air streams of the outside air thus formed are blown from a right side surface 100*b* of the apparatus main body 100 toward a left side surface 100*c* thereof, as shown in FIG. 10 and FIG. 12, whereby the fixing device 6, the cartridges 50 and the laser scanner 10 are respectively cooled, and at the same time the cartridges 50 and the laser scanner 10 are thermally insulated.

Here, the air stream restricting plate 60 has a plurality of restriction plate members 60*b* that are arranged in the gaps, respectively, between the laser scanner 10 and the upper surface portions 48*ay*, 48*am*, 48*ac* of the cartridges 50*y*, 50*m*, 50*c*. In other words, at least a part of the air stream restricting plate 60 overlaps with at least parts of the cartridges 50*y*, 50*m*, 50*c*, as viewed in a direction orthogonal to the drawing direction. And, as shown in FIG. 10 and FIG. 11, the restriction plate members 60*b* are arranged to extend from the right side surface 100*b* of the apparatus main body 100 toward the left side surface 100*c* thereof. As a result, the outside air a supplied to the interior of the apparatus main body 100 by means of the fan 70 can be forced to flow from the right side surface 100*b* of the apparatus main body 100 toward the left side surface 100*c* thereof.

Cooling can be carried out in an efficient manner by arranging these restriction plate members 60*b* at locations much closer to the upper surface portions 48*ay*, 48*am*, 48*ac* of the cartridges 50*y*, 50*m*, 50*c*. That is, the air passages defined by the cartridges 50*y*, 50*m*, 50*c* and the restriction plate members 60*b* are made into more closed spaces, so it is possible to suppress the diffusion of the flow of gas (air streams) flowing from the right side surface 100*b* of the apparatus main body 100 toward the left surface 100*c* thereof. Further, it is also possible to perform cooling in an efficient manner because air streams are able to flow smoothly without obstruction. Here, note that the air stream restricting plate 60 has holes 60*a* formed therein so as to permit the laser beams emitted from the laser scanner 10 to pass therethrough.

In addition, in this embodiment, as stated above, at the time of attaching and detaching a cartridge, the cartridge is moved a distance F in the direction of y1 in the apparatus main body 100 in accordance with the upward movement of the tray 13, as shown in FIG. 5. Therefore, it is necessary to make the gaps between the restriction plate members 60*b* and the upper surface portions 48*ay*, 48*am*, 48*ac* of the developing frame bodies 48 of the cartridges 50*y*, 50*m*, 50*c* in their image forming state of FIG. 1 equal to or larger than the predetermined distance F shown in FIG. 5.

Moreover, in this embodiment, the fixing device 6, which is a heat source having the greatest influence, is arranged at the most upstream side in the drawing direction of the tray 13, so that a large distance between the fixing device 6 and the black cartridge 50*k* can be ensured. Accordingly, the air stream restricting plate 60 is not arranged between the black cartridge 50*k* and the laser scanner 10.

Although in the foregoing description, one embodiment of the present invention has been specifically described, the present invention is not limited to the above-mentioned embodiment, and the invention can be varied into a variety of forms based on the technical concept of the present invention. For example, numerical values enumerated in the above-mentioned embodiment are merely some examples, so numerical values different from these may be used as required.

Figure 13:
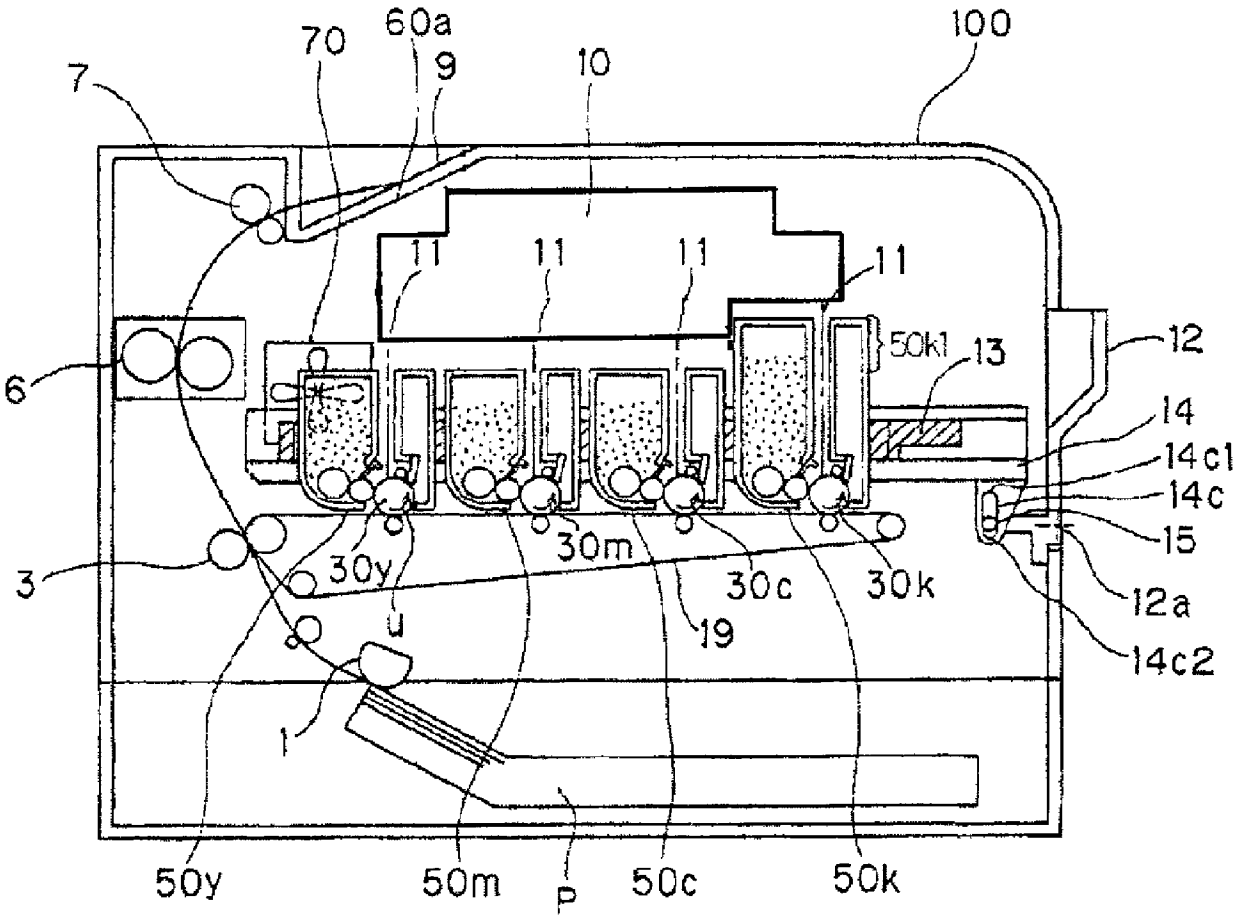
FIG. 13 is a cross sectional view showing the overall construction of the electrophotographic image forming apparatus according to the embodiment of the present invention.

For example, in the above-mentioned embodiment, a description has been provided of the case where the air stream restricting plate 60 is formed separately from the laser scanner 10, but similar advantageous effects can be achieved even if they are formed integrally with each other. In addition, in place of the air stream restricting plate 60 of the above-mentioned embodiment, a portion of the laser scanner 10 may be arranged as the fixed member (see FIG. 13). That is, in FIG. 13, there is illustrated a case where a construction is adopted in which the laser scanner 10 has at least a part of a downwardly protruded portion arranged to overlap with at least a part of the protruded portion 50*k*1, as viewed in the drawing direction.

In this embodiment, the plurality of second cartridges are employed, but only a single second cartridge may instead be used.

In addition, in this embodiment, specific examples of the electrophotographic image forming apparatus include electrophotographic copiers, electrophotographic printers (e.g., laser beam printers, LED printers, etc.), facsimile machines, word processors, and so on.

In addition, in this embodiment, a description has been provided of the case where the cartridges comprise process cartridges, but the present invention can be applied to cartridges that have at least part of an electrophotographic photosensitive member, a process unit, a developer storage portion, etc. That is, the invention can also be applied to cartridges other than the process cartridges of this embodiment. For example, there can be exemplified developer cartridges that have a developer storage portion storing therein a developer, and developing cartridges that have, as a cartridge, the second unit 41 of this embodiment alone. Moreover, the invention can also be applied to cleaner cartridges that have, as a cartridge, the first unit 31 of this embodiment alone, or applied to electrifying cartridges that have an electrifying unit, or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-210107, filed on Aug. 10, 2007, Japanese Patent Application No. 2008-152101, filed on Jun. 10, 2008, and Japanese Patent Application No. 2008-183893, filed on Jul. 15, 2008, which are hereby incorporated by reference in their entirety.

What is claimed is:

1. An image forming apparatus capable of forming an image on a recording medium, said apparatus comprising:

a main body frame; and a supporting member that is movable between an inner position in which said supporting member is located at an inner side of said main body frame and an outer position in which said supporting member is located at an outer side of said main body frame, and that has a mounting portion on which a first cartridge and a second cartridge are detachably mounted, wherein the mounting portion mounts the first cartridge on the most downstream side of said mounting portion in a drawing direction in which said supporting member is drawn out from said inner position to said outer position, and said mounting portion mounts the second cartridge on an upstream side of said the first cartridge in the drawing direction, and in a state where the first cartridge and the second cartridge are mounted on said mounting portion, the first cartridge has a protruded portion that protrudes in an orthogonal direction orthogonal with respect to the drawing direction more than the second cartridge protrudes in the orthogonal direction.

2. The image forming apparatus as set forth in claim 1, wherein said mounting portion mounts the first cartridge having a first developer storage portion that stores a first developer, and the second cartridge having a second developer storage portion that stores a second developer, where the protruded portion forms a part of the first developer storage portion.

3. The image forming apparatus as set forth in claim 2, wherein the first developer storage portion of the first cartridge mounted by said mounting portion is larger than the second developer storage portion of the second cartridge mounted by said mounting portion.

4. The image forming apparatus as set forth in claim 2, wherein the first developer stored in the first developer storage portion of the first cartridge mounted by said mounting portion is a developer of a black color, and the second developer stored in the second developer storage portion of the second cartridge mounted by said mounting portion is a developer of a color other than the black color.

5. The image forming apparatus as set forth in claim 1, wherein each of the first cartridge mounted by said mounting portion and the second cartridge mounted by said mounting portion has a developing roller that is rotatable about an axis orthogonal to the drawing direction so as to develop a latent image formed on an image bearing member; and in a state where the first cartridge and the second cartridge are mounted on said mounting portion, said the protruded portion protrudes in a direction orthogonal to both the direction of the axis and the drawing direction more than said second cartridge does.

6. The image forming apparatus as set forth in claim 1, further comprising:

a fixed member that is fixed in said main body frame;

wherein in a state where said mounting portion mounts the first cartridge and the second cartridge, and said supporting member is located in said inner position, at least a part of said fixed member overlaps with at least a part of the protruded portion as viewed in the drawing direction.

7. The image forming apparatus as set forth in claim 6, wherein in a state where said mounting portion mounts the first cartridge and the second cartridge and said supporting member is located in said inner position, at least a part of said fixed member overlaps with at least a part of the second cartridge, as viewed in a direction orthogonal to the drawing direction.

8. The image forming apparatus as set forth in claim 6, wherein said fixed member is a restriction unit that restricts air streams in said main body frame.

9. The image forming apparatus as set forth in claim 6, wherein said fixed member is an exposure unit that exposes an image bearing member so as to form a latent image.

10. The image forming apparatus as set forth in claim 1, further comprising:

an exposure unit that exposes an image bearing member so as to form a latent image; and a transfer unit that transfers a developer image formed on the image bearing member to the recording medium, wherein said supporting member is located between said exposure unit and said transfer unit with said supporting member being located in said inner position.

11. The image forming apparatus as set forth in claim 10, further comprising:

a restriction unit that restricts air streams in said main body frame, wherein in a state where said mounting portion mounts the first cartridge and the second cartridge and said supporting member is located in said inner position, at least a part of said restriction unit overlaps with at least a part of the protruded portion as viewed in the drawing direction, and said restriction unit is located between the second cartridge and said exposure unit.

12. The image forming apparatus as set forth in claim 1, further comprising:

the first cartridge and the second cartridge.

13. The image forming apparatus as set forth in claim 1, further comprising:

a fixing unit that fixes a developer image to the recording medium;

wherein in a state where said supporting member is located in said inner position, said fixing unit is located at an upstream side of said supporting member in the drawing direction.

14. The image forming apparatus as set forth in claim 1, wherein each of the first cartridge mounted by mounting portion and said the second cartridge mounted by said mounting portion includes a first unit having an image bearing member on which a latent image is formed, and a second unit having a developing roller that develops the latent image.

15. The image forming apparatus as set forth in claim 14, wherein the first unit of the first cartridge is different in shape from the first unit of the second cartridge, and the second unit of the first cartridge is identical in shape to the second unit of the second cartridge, and the first unit of the first cartridge has the protruded portion.

16. The image forming apparatus as set forth in claim 1, wherein said mounting portion detachably mounts at least one additional second cartridge.

17. An image forming apparatus capable of forming an image on a recording medium, said apparatus comprising:

a main body frame; and a supporting member that is movable between an inner position in which the supporting member is located at an inner side of said main body frame and an outer position in which said supporting member is located at an outer side of said main body frame, and that has a mounting portion on which a first cartridge and a second cartridge are detachably mounted, wherein said mounting portion mounts the first cartridge on the most downstream side of said mounting portion in a drawing direction in which said supporting member is drawn out from said inner position to said outer position, and said mounting portion mounts the second cartridge on an upstream side of the first cartridge in the drawing direction, and the first cartridge is larger than the second cartridge.

* * * * *